US011060521B2

(12) United States Patent
Seol et al.

(10) Patent No.: US 11,060,521 B2
(45) Date of Patent: Jul. 13, 2021

(54) ROTARY COMPRESSOR HAVING A ROLLING PISTON WITH COUPLING GROOVE

(71) Applicant: LG ELECTRONICS INC., Seoul (KR)

(72) Inventors: Seseok Seol, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 35 days.

(21) Appl. No.: 16/544,170

(22) Filed: Aug. 19, 2019

(65) Prior Publication Data

US 2020/0056612 A1 Feb. 20, 2020

(30) Foreign Application Priority Data

Aug. 17, 2018 (KR) ..... 10-2018-0096170
Aug. 17, 2018 (KR) ..... 10-2018-0096171

(51) Int. Cl.
*F04C 18/324* (2006.01)
*F04C 2/356* (2006.01)
(Continued)

(52) U.S. Cl.
CPC ..... *F04C 18/324* (2013.01); *F01C 21/0809* (2013.01); *F04C 2/3564* (2013.01);
(Continued)

(58) Field of Classification Search
CPC ..... F04C 29/02–29/028; F04C 18/324; F04C 18/3562; F04C 21/0809; F04C 2/3441; F04C 2/3564; F04C 2240/20
See application file for complete search history.

(56) References Cited

U.S. PATENT DOCUMENTS 10,550,696 B2 2/2020 Cho et al.
2017/0275996 A1* 9/2017 Cho ..... F01C 21/0809

FOREIGN PATENT DOCUMENTS

CN 102016320 A 4/2011
CN 106715912 A 5/2017
(Continued)

OTHER PUBLICATIONS

KR101409874 English Translation; obtained from KIPRIS website on Nov. 18, 2020 (Year: 2020).*
(Continued)

*Primary Examiner* — Bryan M Lettman
(74) *Attorney, Agent, or Firm* — KED & Associates, LLP

(57) ABSTRACT

A rotary compressor includes a cylinder, a drive unit, a piston, a vane, and an oil passage. The cylinder includes a suction chamber for suctioning fluid and a compression chamber for compressing fluid. The drive unit rotates a drive shaft by connecting to the cylinder. The piston oscillates in the cylinder by connecting to the drive shaft. The vane extends between the cylinder and the piston so as to separate the suction chamber from the compression chamber, and some parts of the length of the vane are inserted into a slide groove formed in the cylinder. One end of the vane is connected to the coupling groove formed in the piston. The oil passage is disposed between one end of the vane and the rolling piston so as to receive oil therethrough.

19 Claims, 9 Drawing Sheets

(51) Int. Cl.

| | |
|---|---|
| ***F04C 29/02*** | (2006.01) |
| ***F01C 21/08*** | (2006.01) |
| ***F04C 18/356*** | (2006.01) |

(52) U.S. Cl.

CPC ..... *F04C 18/3562* (2013.01); *F04C 29/028* (2013.01); *F04C 2240/20* (2013.01)

(56) References Cited

FOREIGN PATENT DOCUMENTS

| | | | |
|---|---|---|---|
| JP | H04255591 | * | 9/1992 |
| JP | H 04255591 | | 9/1992 |
| JP | H 06257579 | | 9/1994 |
| JP | H08151988 | * | 6/1996 |
| JP | H 08151988 | | 6/1996 |
| JP | H 10148193 | | 6/1998 |
| JP | H 11294353 | | 10/1999 |
| JP | 3600694 | * | 12/2004 |
| JP | 5542675 | | 7/2014 |
| JP | 2014-240634 | | 12/2014 |
| KR | 10-2010-0000369 A | | 1/2010 |
| KR | 10-2012-0018911 | | 3/2012 |
| KR | 10-1409874 | | 6/2014 |
| KR | 101409874 | * | 6/2014 |
| KR | 10-1510698 | | 4/2015 |
| KR | 101510698 | * | 4/2015 |

OTHER PUBLICATIONS

JP3600694 English Translation; obtained from EPO website on Nov. 18, 2020 (Year: 2020).*

Korean Office Action dated Aug. 27, 2019 issued in Application No. 10-2018-0096170.

Korean Office Action dated Aug. 27, 2019 issued in Application No. 10-2018-0096171.

Korean Notice of Allowance dated Dec. 5, 2019 issued in Application No. 10-2018-0096171.

European Search Report dated Jan. 8, 2020 issued in Application No. 19192207.9.

Chinese Office Action dated Dec. 25, 2020 issued in Application 201910759167.9 and English translation.

* cited by examiner (a)

(b)

ROTARY COMPRESSOR HAVING A ROLLING PISTON WITH COUPLING GROOVE

CROSS-REFERENCE TO RELATED APPLICATION

This application claims priority under 35 U.S.C. § 119 to Korean Application Nos. 10-2018-0096170 and 10-2018-0096171 filed on Aug. 17, 2018, whose entire disclosures are hereby incorporated by reference.

BACKGROUND

1. Field

The present disclosure relates to a rotary compressor.

2. Background

Generally, a rotary compressor includes a cylinder in which a suction chamber and a compression chamber are installed, and a piston configured to oscillate in the cylinder.

The suction chamber and the compression chamber can be separated from each other by a vane. Some longitudinal parts of the vane may be slidably inserted into a sliding groove of the cylinder, and one end of the vane may be coupled to a coupling groove formed in a circumference of the piston.

When the rotary compressor is driven to oscillate the piston, friction may occur between one end of the vane and the coupling groove.

Therefore, when oil is not sufficiently supplied between the one end of the vane and the coupling groove, efficiency of the compressor may be deteriorated due to abrasion of the one end of the vane and the coupling groove.

In addition, when an oil film is incompletely formed between the one end of the vane and the coupling groove of the piston, compression efficiency of the compressor may be degraded due to leakage of fluid to be compressed.

On the other hand, one end of the vane should be oscillatably coupled to the coupling groove, so that an inner circumferential surface of the coupling groove should be precisely processed (or machined) to correspond to an outer circumferential surface of the one end of the vane.

In addition, in order to prevent one end of the vane from being separated from the coupling groove, there is a need for a structure for preventing separation of the one end of the vane to be applied to the coupling groove.

As described above, in order to precisely process the coupling groove at the outer circumferential surface of the rolling piston, costs for such processing may be greatly increased and a long period of time may be consumed to perform such processing.

According to a conventional rotary compressor, in order to prevent occurrence of seizure caused by friction between the vane and the rolling piston, the conventional rotary compressor should be designed to include the vane and the rolling piston that are formed of different materials.

In addition, the conventional rotary compressor has difficulty in supplying a sufficient amount of oil needed to prevent damage caused by friction between one end of the vane and the coupling groove of the rolling piston.

BRIEF DESCRIPTION OF THE DRAWINGS

The embodiments will be described in detail with reference to the following drawings in which like reference numerals refer to like elements wherein.

DETAILED DESCRIPTION

Figure 1:
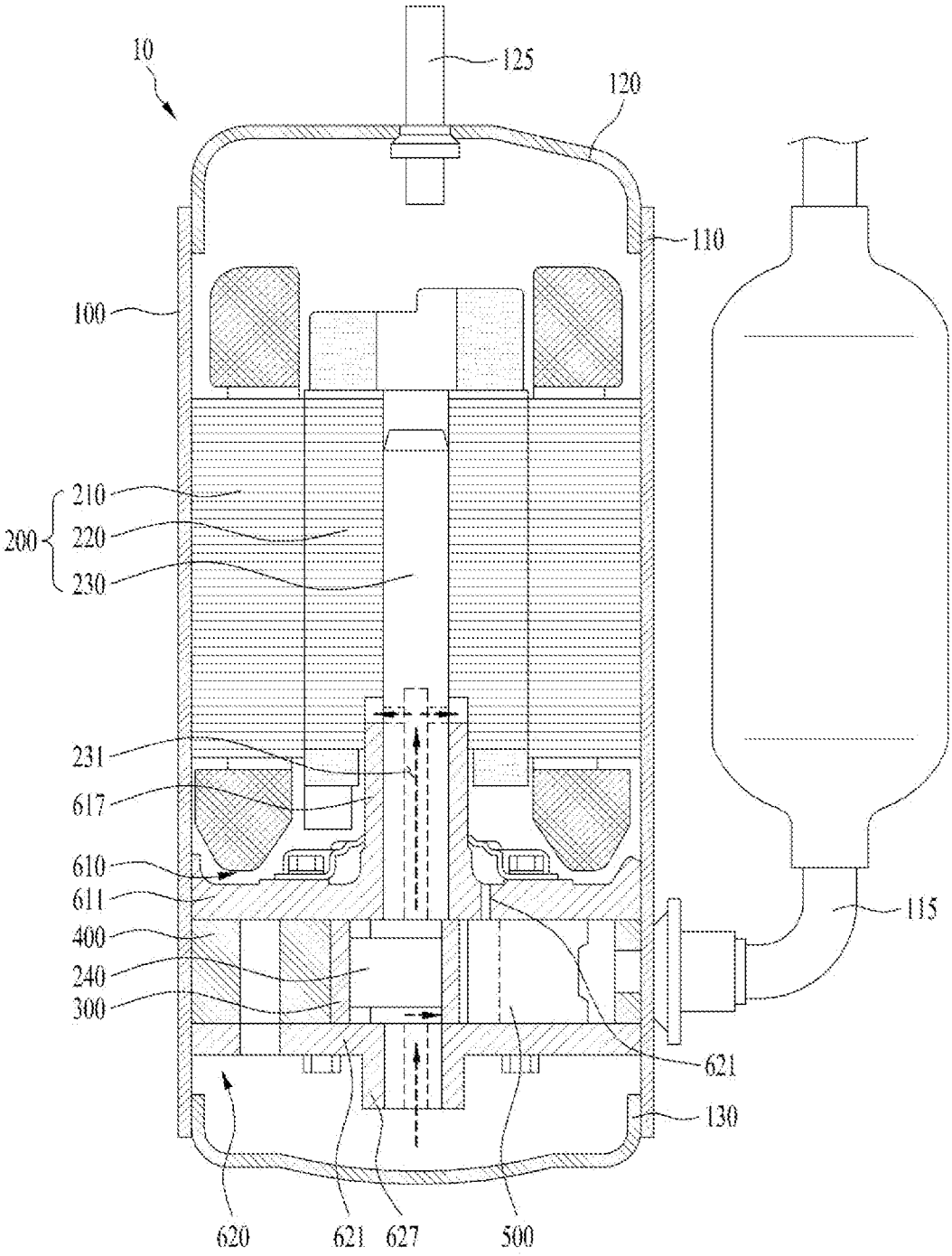
FIG. 1 is a longitudinal cross-sectional view illustrating a rotary compressor according to an embodiment of the present disclosure.

Hereinafter, a rotary compressor according to the present disclosure will be described in detail with reference to the accompanying drawings. The accompanying drawings illustrate the exemplary embodiments of the present disclosure. The exemplary embodiments of the present disclosure are merely provided to describe the present disclosure in detail, and the technical range of the present disclosure is not limited by the exemplary embodiments.

In addition, the same reference numbers will be used throughout the drawings to refer to the same or like parts, and duplicate descriptions thereof will be omitted. In the drawings, the sizes, thicknesses, and shapes of constituent elements may be exaggerated or reduced for convenience of description.

FIG. 1 is a longitudinal cross-sectional view illustrating a rotary compressor according to an embodiment of the present disclosure. In more detail, FIG. 1 is a longitudinal cross-sectional view of a single rotary compressor in which a single cylinder and a single rolling piston are installed. Unless otherwise indicated, fluid may refer to refrigerant (especially, gaseous refrigerant).

Referring to FIG. 1, the rotary compressor 10 according to one embodiment may include a case 100, a motor 200 disposed in the case 100, a rolling piston 300 driven by the motor 200, a cylinder 400 provided with an oscillation space of the rolling piston 300, and a vane 500 by which a space of the cylinder 400 is divided into a suction chamber and a compression chamber.

Oscillation of the rolling piston 300 may indicate that a radial center of the rolling piston 300 revolves around the center C (see FIG. 6) of a rotary shaft.

The case 100 may include a hollow side case 110 to form a side surface thereof, a first case 120 to cover one end of the side case 110, and a second case 130 to cover the other end of the side case 110.

The side case 110 may be connected to an inlet passage 115 through which fluid can be introduced into the rotary compressor 10. The inlet passage 115 may be formed to communicate with the suction chamber contained in the cylinder 400.

The first case 120 may be connected to a discharge passage 125 through which compressed fluid can be discharged outside. The discharge passage 125 may be formed to communicate with the compression chamber contained in the cylinder 400 through the space formed in the case 100.

The second case 130 may include oil that lubricates frictional surfaces of constituent elements contained in the rotary compressor 10. For example, oil may be stored in a lower part of the case 100. The oil stored in the second case 130 may be supplied to frictional surfaces of a bearing and an eccentric part 240, etc. through an oil-supply hole formed in a drive shaft of a motor 200 to be described later. Arrows indicated in FIG. 1 may refer to a path through which oil is supplied.

The motor 200 may be driven by an external power source. The motor 200 may include a stator 210 fixed in the case 100, a rotor 220 rotatably installed in the radial direction of the stator 210, and a drive shaft 230 press-fitted into the radial center part of the rotor 220.

An oil-supply hole 231 extending in the longitudinal direction of the drive shaft 130 may be provided in the radial direction of the drive shaft 130. The oil-supply hole 231 may be branched into a plurality of hole sections in the direction of frictional surfaces such as the bearing and the eccentric part 240.

The rolling piston 300 may be driven by the motor 200. The drive shaft 230 of the motor 200 may be coupled to the rolling piston 300.

In detail, the drive shaft 230 may be provided with the eccentric part 240, and the eccentric part 240 may be coupled to the rolling piston 300. For example, the rolling piston 300 may be formed in a ring shape, and the eccentric part 240 may be inserted into the center part of the rolling piston 300. The rolling piston 300 may be installed to oscillate (or move) in the space formed in the cylinder 400, and may also be referred to as a roller.

The cylinder 400 may include a space formed in the radial direction thereof, so that the rolling piston 300 can be received or accommodated in the space. The space may be formed to have a sufficient size in a manner that the rolling piston 300 can sufficiently oscillate. The space formed in the cylinder 400 may include a suction chamber into which fluid can be suctioned and a compression chamber in which the suctioned fluid is compressed.

The vane 500 may be formed to divide the space formed in the cylinder 400 into the suction chamber and the compression chamber.

Specifically, the suction chamber may be partitioned into a plurality of sections by one side of the vane 400, the outer circumferential surface of the rolling piston 300, and the inner circumferential surface of the cylinder 400. The compression chamber may be partitioned into a plurality of sections by the other side of the vane 500, the outer circumferential surface of the rolling piston 300, and the inner circumferential surface of the cylinder 400.

The vane 500 may be formed to extend between the rolling piston 300 and the cylinder 400. By the vane 500, the rolling piston 300 may oscillate along the inner circumferential surface of the cylinder 400 without revolving in the inner space of the cylinder 400 by the vane 500. Here, such oscillation of the rolling piston 300 may indicate that the rolling piston 300 rotates in the cylinder 400 in a state in which some parts of the outer circumferential surface of the rolling piston 300 are in contact with some parts of the inner circumferential surface of the cylinder 400.

The rotary compressor 10 may further include bearings 610 and 620 to support the drive shaft 230. The bearings 610 and 620 may be classified into a first bearing 610 coupled to the cylinder 400 at one side of the cylinder 400 and a second bearing 620 coupled to the cylinder at the other side of the cylinder 400.

The first bearing 610 may include a first bearing body 611 and a first bearing housing 617. The first bearing body 611 corresponding to an upper bearing body may allow one surface of the suction chamber and one surface the compression chamber to be partitioned from each other. The upper bearing housing 617 may protrude from the center part of the first bearing body 611 to one side of the first bearing body 611, and may be formed to support some parts of the drive shaft 230 (e.g., the center part of the drive shaft 230).

The second bearing 620 may include a second bearing body 621 and a second bearing housing 627. The second bearing body 621 may allow the other surface of the suction chamber and the other surface of the compression chamber to be partitioned from each other. The second bearing housing 627 may protrude from the center part of the lower bearing body 621 to the other side of the lower bearing 621, and may be formed to support some parts of the drive shaft 240 (e.g., a lower part of the drive shaft 230).

The coupling relationship between the rolling piston 300 and the cylinder 400 will hereinafter be described with reference to other drawings.

Figure 2:
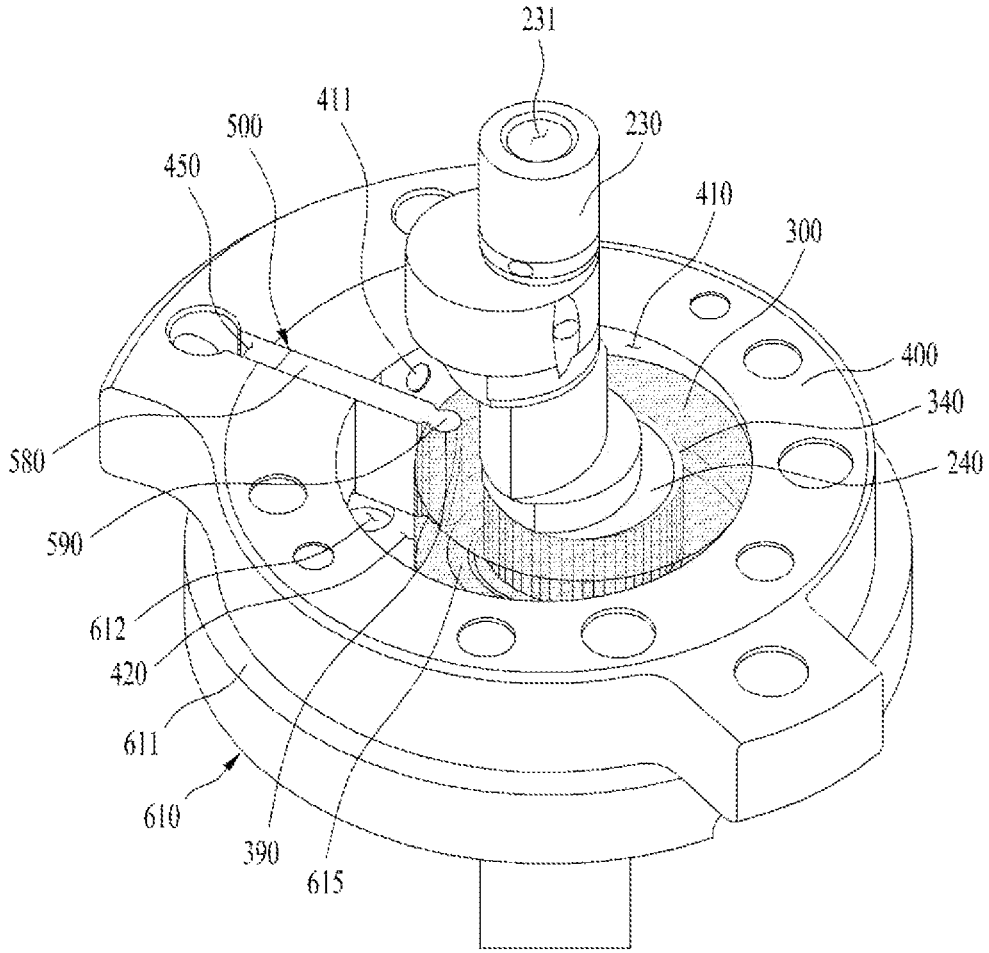
FIG. 2 is a perspective view illustrating the coupling relationship between a piston and a vane disposed in a cylinder.

FIG. 2 is a perspective view illustrating the coupling relationship between the piston and the vane disposed in a cylinder. In detail, FIG. 2 is a perspective view illustrating a coupling state in which the rolling piston and the vane are coupled to each other.

Referring to FIG. 2, the eccentric part 240 of the drive shaft 230 may be coupled to the rolling piston 300. For example, a coupling hole 340 may be formed at the radial center of the rolling piston 300, and the eccentric part 240 may be press-fitted into the coupling hole 340.

The inner space of the cylinder 400 may be divided into a suction chamber 410 and a compression chamber 420. The suction chamber 410 and the compression chamber 420 may be separated from each other by the vane 500.

The cylinder 400 may be provided with an inlet 411 through which fluid is introduced. The inlet 411 may be formed to communicate with the suction chamber 410. In more detail, the inlet passage 115 and the suction chamber 410 may communicate with each other through the inlet 411.

An outlet 612 communicating with the compression chamber 420 may be formed in the first bearing 610. In more detail, the outlet 612 may be formed in the first bearing body 611. The outlet passage 125 and the compression chamber 420 may be formed to communicate with each other through the outlet 612.

A slide groove 450 in which some parts of the vane 500 are inserted may be formed in the cylinder 400. In more detail, the slide groove 450 may be formed to extend radially outward from the cylinder 400. In addition, a longitudinal rear end of the vane 500 may be movable in the slide groove 450 in the extension direction of the slide groove 450.

When the rotary compressor 10 is driven, the vane 500 may be formed to reciprocate along the slide groove 450 without being separated from the slide groove 450.

One end of the vane 500 may be connected to a coupling groove 390 formed in the rolling piston 300. The one end of the vane 500 may be oscillatably coupled to the coupling groove 390.

For example, the coupling groove 390 may be formed to be opened toward the one end of the vane 500, and may include a cylindrical circumference. In addition, the one end of the vane 500 may be oscillatably connected to the coupling groove 390 along the inner circumferential surface of the coupling groove 390.

In more detail, the vane 500 may include a slide part 580 slidably inserted into the slide groove 450 and a coupling part 590 oscillatably connected to the coupling groove 390. The slide part 580 and the coupling part 590 may be integrated with each other. The coupling groove 390 may be identical in height to the coupling part 590.

The slide groove 450 and the slide part 580 may be formed to extend in a straight line.

The coupling part 590 may be provided at one end of the vane 500. The outer circumferential surface of the coupling part 590 may be formed in a shape corresponding to the inner circumferential surface of the coupling groove 390.

For example, the coupling part 590 may include an arc part, a cross-section of which is formed in an arc shape having an angle of 180° or more (preferably, at least 200°), and the inner circumferential surface of the coupling groove may be formed to correspond to the shape of the arc part.

Oil supplied through the oil-supply hole 231 of the drive shaft 230 may be branched from the oil-supply hole 231, so that the oil may be introduced into the first bearing 610 and the second bearing 620.

Each of the bearings 610 and 620 may include a ring-shaped stepped portion in which oil introduced through the oil-supply hole 231 is stored.

In the illustrated embodiment, oil introduced into the first bearing 610 may be received in the step part 615 formed in the center part of the first bearing 610. The stepped part 615 may be formed at the inner surface of the first bearing 610. For example, the stepped part 615 may be formed at the bottom surface of the first bearing body 611.

One surface of the rolling piston 300 and one surface of the first bearing 610 can be lubricated by oil stored in the stepped part 615. In addition, by oil stored in the stepped part 615, fluid can be prevented from leaking between the one surface of the rolling piston 300 and the one surface of the first bearing 610.

Although not shown in FIG. 2, the stepped part for storing oil introduced into the second bearing 620 may also be formed in the second bearing 620. The stepped part of the second bearing 620 may be formed at the inner surface (i.e., the top surface of the lower bearing body 621) of the second bearing 620.

Meanwhile, when the rotary compressor 10 is driven, friction may occur between the outer circumferential surface of the coupling part 590 and the coupling groove 390. Accordingly, there is a need for oil to be supplied between the outer circumferential surface of the coupling part 590 and the coupling groove 390.

Therefore, an oil passage F may be provided between one end of the vane 500 and the coupling groove 390. A longitudinal end of the oil passage F may intermittently communicate with the above stepped part, so that oil stored in the stepped part can be introduced into the oil passage F. Embodiments of the oil passage F will hereinafter be described with reference to other drawings.

Figure 3:
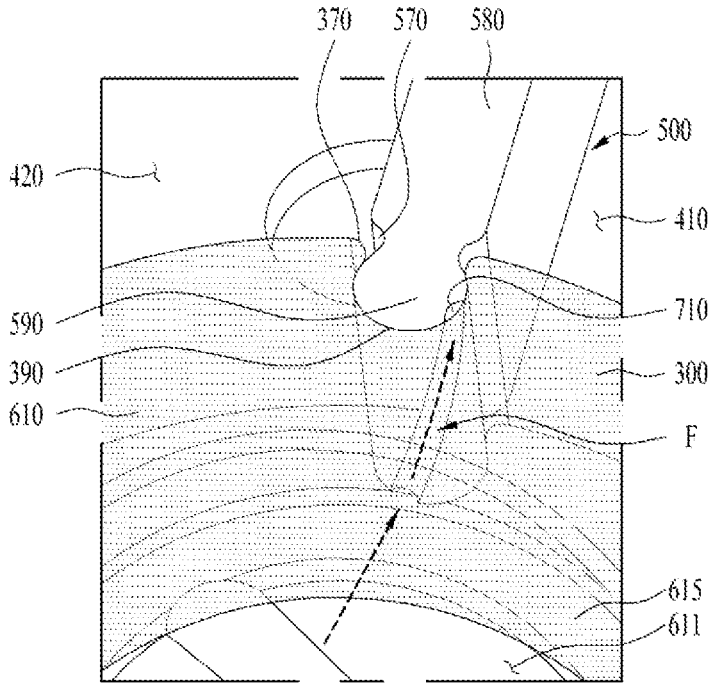
FIG. 3 is a view illustrating an oil-supply structure between a vane and a piston according to a first embodiment of the present disclosure.
Figure 3:
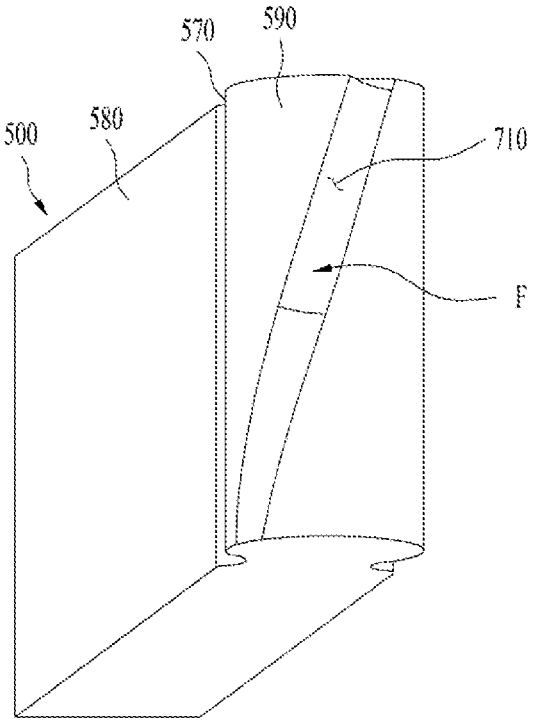

FIG. 3 is a view illustrating an oil-supply structure between the vane and the piston according to a first embodiment of the present disclosure. In more detail, FIG. 3(*a*) is a view illustrating the coupling state between the vane and the rolling piston, and FIG. 3(*b*) is a perspective view illustrating only the vane.

Referring to FIG. 3, the coupling part 590 of the vane 500 may be oscillatably fastened to the coupling groove 390 formed around one side of the rolling piston 300.

In order to prevent the coupling part 590 from being separated from the coupling groove 390, the coupling groove 390 may be formed to surround some part of the circumference of the coupling part 590. For example, the cross-sectional surface of the coupling part 590 may include an arc part having an angle of at least 200°, and the coupling groove 390 may be formed to surround the arc part.

The vane 500 may include a concave part 570 formed between the slide part 580 and the coupling part 590. The concave part 570 may be recessed inward of a thickness direction of the vane 500 at both sides of the vane 500.

The rolling piston 300 may include a protrusion part 370 protruding toward the concave part 570. The protrusion part 370 may be provided at both ends of the coupling groove 390. In other words, the protrusion part 370 may be provided at an inlet of an opening portion that is opened toward the slide part 580 of the vane 500 at the coupling groove 390.

When the rotary compressor is driven (i.e., when the rolling piston oscillates in the cylinder), friction may occur between the outer circumferential surface of the coupling part 590 and the inner circumferential surface of the coupling groove 390.

Due to friction between the outer circumferential surface of the coupling part 590 and the inner circumferential surface of the coupling groove 390, the vane 500 or the rolling piston 300 may be damaged. In addition, due to friction between the outer circumferential surface of the coupling part 590 and the inner circumferential surface of the coupling groove 390, fluid (e.g., refrigerant) may leak outside.

For example, refrigerant may leak from the suction chamber 410 to the compression chamber 420, or may leak from the compression chamber 420 to the suction chamber 410.

In order to address the above-mentioned issues, it is necessary for oil to be supplied between the outer circumferential surface of the coupling part 590 and the inner circumferential surface of the coupling groove 390. In particular, it is preferable that oil be applied to the entire spacing between the outer circumferential surface of the coupling part 590 and the inner circumferential surface of the coupling groove 390.

For example, an oil passage F may be provided between one end of the vane 500 and the coupling groove 390. Oil may be supplied between the one end of the vane 500 and the coupling groove 390 through the oil passage F.

Specifically, the oil passage F may be provided between the coupling part 590 and the coupling groove 390. Therefore, oil supplied to the oil passage F may be applied to a frictional surface between the coupling part 590 and the coupling groove 390.

The oil passage F may be provided between the outer circumferential surface of the coupling part 590 and the inner circumferential surface of the coupling groove 390. Accordingly, although friction occurs between the outer circumferential surface of the coupling part 590 and the inner circumferential surface of the coupling groove 390 by oscillation of the rolling piston 300, the outer circumferential surface of the coupling part 590 and the inner circumferential surface of the coupling groove 390 may be lubricated by oil.

The oil passage F may be provided in at least one of the arc part of the coupling part 590 and the inner circumferential surface of the coupling groove 390.

In the present embodiment, the oil passage F may include a first oil groove 710 provided at the outer circumferential surface of the coupling part 590. Specifically, the first oil groove 710 may be recessed inward of the radial direction of the coupling part 590. The first oil groove 710 may extend in a longitudinal direction of the coupling part 590.

Preferably, the first oil groove 710 may be formed to extend throughout the longitudinal direction of the coupling part 590. In addition, one end and the other end of the first oil groove 710 may be opened.

Accordingly, through oil supplied to the first oil groove 710, oil can be efficiently applied to the outer circumferential surface of the coupling part 590 and the inner circumferential surface of the coupling groove 390 in the longitudinal directions of the coupling part 590 and the coupling groove 390.

The above-mentioned upper bearing may be provided with a stepped part 615 that is formed around the first bearing hole 611 coupled to the drive shaft. In other words, the ring-shaped stepped part 615 may be provided at the center part of the first bearing body 610.

When oil supplied through the oil-supply hole provided in the drive shaft is branched to flow into the inner circumferential surface of the first bearing hole 611, oil may flow into the stepped part 615 and may be stored in the stepped part 615.

When the rolling piston 300 oscillates, the oil passage F may be formed to intermittently communicate with the stepped part 615. When the oil passage F communicates with the stepped part 615, oil stored in the stepped part 615 may flow into the oil passage F.

That is, both longitudinal ends of the first oil groove 710 may be opened. When the vane 500 oscillates by movement of the rolling piston 300, the first oil groove 710 may be formed to intermittently communicate with the stepped part 615. In other words, one end of the first oil groove 710 may be formed to intermittently communicate with the stepped part 615. When the first oil groove 710 communicates with the stepped part 615, oil stored in the stepped part 615 may flow into the first oil groove 710.

Although not shown in the drawings, the stepped part of the bearing formed to store oil therein may also be formed in the second bearing.

On the other hand, oil is preferably applied to the entirety of the outer circumferential surface of the coupling part 590 and the inner circumferential surface of the coupling groove 390.

In the present embodiment, the oil passage F may extend in a spiral shape in the longitudinal direction of the coupling part 590. In other words, the first oil groove 710 may extend in the longitudinal direction of the coupling part 590, and may also extend while spirally winding at least some parts of the circumference of the coupling part 590. That is, the first oil groove 710 may be formed to spirally surround at least some parts of the outer circumference of the coupling part 590.

Therefore, when oil is supplied to the oil passage F, oil can be uniformly applied to the entirety of the outer circumferential surface of the coupling part 590 and the inner circumferential surface of the coupling groove 390.

An oil-supply structure between the vane and the rolling piston according to another embodiment of the present disclosure will hereinafter be described with reference to the other drawings.

Figure 4:
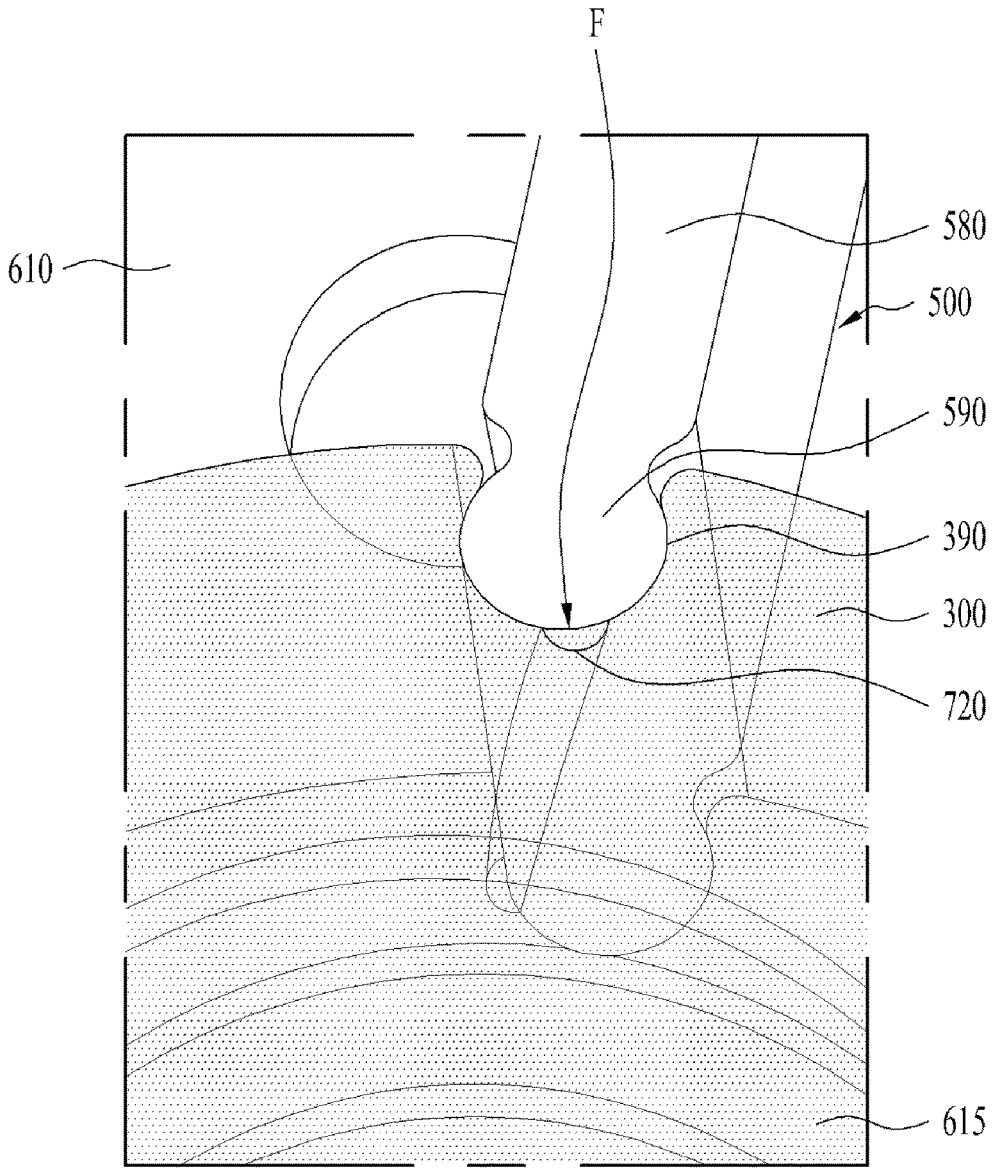
FIG. 4 is a view illustrating an oil-supply structure between a vane and a piston according to a second embodiment of the present disclosure.

FIG. 4 is a view illustrating an oil-supply structure between the vane and the piston according to a second embodiment of the present disclosure. For convenience of description and better understanding of the present disclosure, the following embodiment will hereinafter be described centering upon characteristics different from the first embodiment, and the same constituent elements as in the first embodiment will herein be omitted for brevity.

Referring to FIG. 4, the oil passage F in the present embodiment may include a second oil groove 720 formed at the inner circumferential surface of the coupling groove 390. Specifically, the oil passage F may be recessed outward of the radial direction of the coupling groove 390 at the inner circumferential surface of the coupling groove 390.

That is, according to the present embodiment, the first oil groove shown in FIG. 3 may not be provided as necessary. Instead of the first oil groove, oil may be supplied between the outer circumferential surface of the coupling part 590 and the inner circumferential surface of the coupling groove 390 through the second groove 720.

The second oil groove 720 may be formed to extend throughout the longitudinal direction of the coupling groove 390. In addition, the second oil groove 720 may extend while spirally winding at least some parts of the circumference of the coupling groove 390. In other words, the second oil groove 720 may be formed to spirally surround at least some parts of the inner circumference of the coupling groove 390.

Even in the present embodiment, oil stored in the stepped part of the bearing may be introduced into the second oil groove 720.

One surface and the other surface of the second oil groove 720 may be partially opened. Therefore, when the rolling piston 300 oscillates, the stepped part 615 formed in the upper bearing body 610 may intermittently communicate with the second oil groove 720. That is, the stepped part 615 and one end of the second oil groove 720 may intermittently communicate with each other. When the stepped part 615 communicates with the second oil groove 720, oil stored in the stepped part 615 may be introduced into the second oil groove 720.

By oil supplied to the second oil groove 720, oil may be supplied between the outer circumferential surface of the coupling part 590 and the inner circumferential surface of the coupling groove 390 throughout the entire height of the coupling groove 390.

Since the second oil groove 720 is formed in a spiral shape, oil may be supplied between the outer circumferential surface of the coupling part 590 and the inner circumferential surface of the coupling groove throughout the entire circumference of the coupling groove 390.

An oil-supply structure between the vane and the rolling piston according to still another embodiment of the present disclosure will hereinafter be described with reference to the other drawings.

Figure 5:
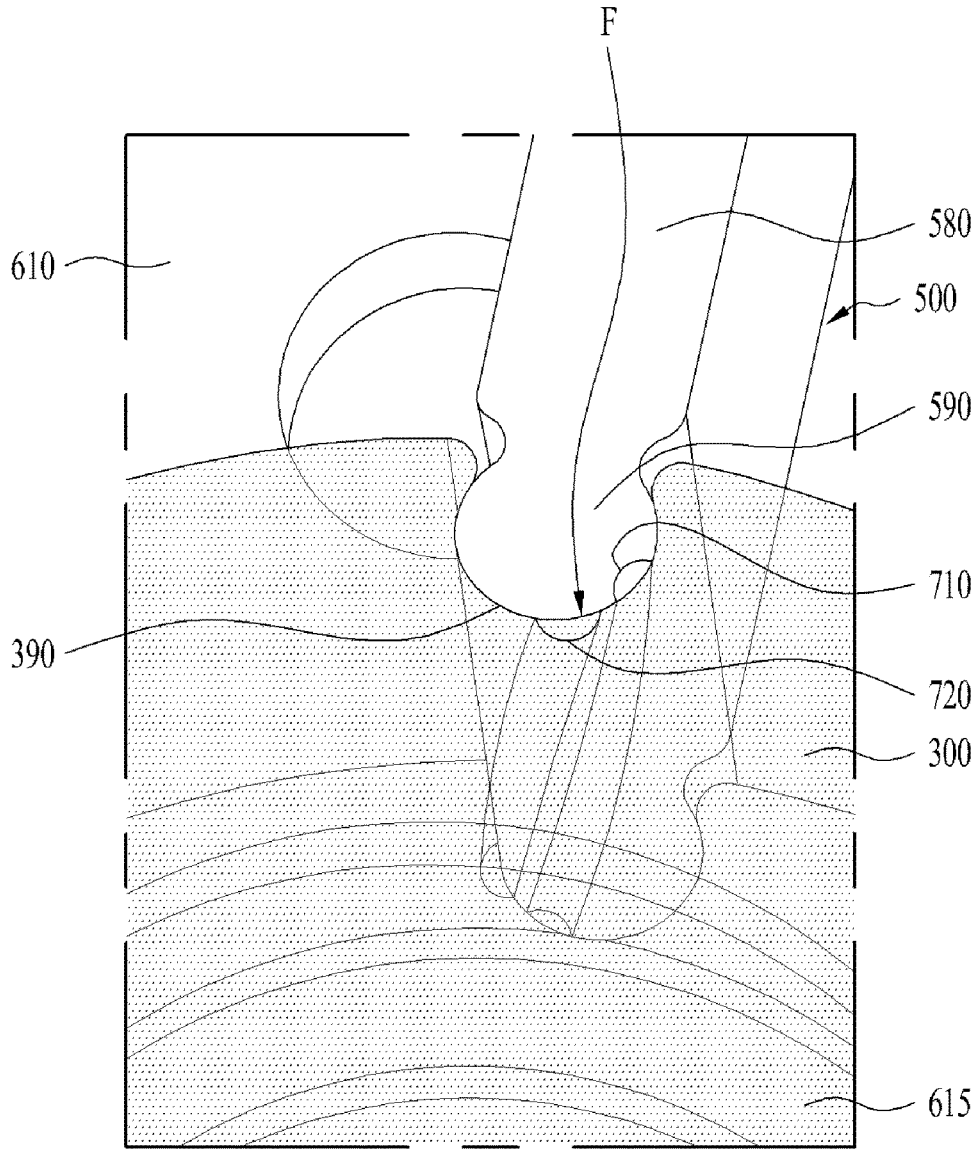
FIG. 5 is a view illustrating an oil-supply structure between a vane and a piston according to a third embodiment of the present disclosure.

FIG. 5 is a view illustrating an oil-supply structure between the vane and the piston according to a third embodiment of the present disclosure. For convenience of description and better understanding of the present disclosure, the following embodiment will hereinafter be described centering upon characteristics different from those of the first and second embodiments, and the same constituent elements as in the first embodiment will herein be omitted for brevity.

Referring to FIG. 5, the oil passage F through which oil can be supplied between the outer circumferential surface of the coupling part 590 and the inner circumferential surface of the coupling groove 390 may include a first oil groove 710 formed at the outer circumferential surface of the coupling part 590 and a second oil groove 720 formed at the inner circumferential surface of the coupling groove 390.

The first oil groove 710 may be recessed inward of the radial direction of the coupling part 590 at the outer circumferential surface of the coupling part 590. The first oil groove 710 may extend in the longitudinal direction of the coupling part 590. In addition, the first oil groove 710 may extend in a spiral shape that is formed to surround at least some parts of the outer circumference of the coupling part 590.

The second oil groove 720 may be recessed outward of the radial direction of the coupling groove 390 at the inner circumferential surface of the coupling groove 390. The second oil groove 720 may be formed to extend in the longitudinal direction of the coupling groove 390. In addition, the second oil groove 720 may be formed to extend in a spiral shape that is formed to surround at least some parts of the inner circumference of the coupling groove 390.

Therefore, when the rolling piston 300 oscillates, the first oil groove 710 and the second oil groove 720 may intermittently communicate with the ring-shaped stepped part 615 formed in the bearing. When the first oil groove 710 and the second oil groove 720 communicate with the stepped part 615, oil stored in the stepped part 615 may be introduced into the first oil groove 710 and the second oil groove 720.

In accordance with the present embodiment, a sufficient amount of oil can be supplied between the outer circumferential surface of the coupling part 590 and the inner circumferential surface of the coupling groove 390 through the first oil groove 710 and the second oil groove 720.

The first oil groove 710 and the second oil groove 720 may have shapes corresponding to each other. That is, the first oil groove 710 and the second oil groove 720 may be formed in the same spiral shape. In other words, although the first oil groove 710 and the second oil groove 720 are different in formation position from each other, the first oil groove 710 may be identical in extension direction and shape to the second oil groove 720.

During oscillation of the rolling piston 300, the first oil groove 710 and the second oil groove 710 may be arranged to intermittently face each other. When the first oil groove 710 and the second oil groove 720 face each other, oil flowing into the first oil groove 710 and oil flowing into the second oil groove 720 may intermingle. Therefore, although the amount of oil flowing into any one of the oil grooves is relatively small, when the first oil groove 710 and the second oil groove face each other, oil can be evenly distributed to the first oil groove 710 and the second oil groove 720.

Meanwhile, referring back to FIG. 1, the second bearing 610 may include a second bearing body 621 and a second bearing housing 627. The second bearing body 621 may allow the other surface of the suction chamber and the other surface of the compression chamber to be partitioned. The second bearing housing 627 may protrude from the center part of the second bearing body 621 to the other side, and may be formed to support some parts of the drive shaft 240. In the meantime, one end of the vane 500 may be slidably inserted into the slide groove formed in the cylinder 400, and the other end of the vane 500 may be oscillatably coupled to a coupling groove (to be described later) formed in the rolling piston 300. In order to minimize frictional force between the other end of the vane 500 and the coupling groove, there is a need for the inner circumferential surface of the coupling groove to be precisely processed (or machined) in a manner that the inner circumferential surface of the coupling groove has a shape corresponding to the shape of the other end of the vane 500. In this case, high-cost equipment capable of precisely processing the inner circumferential surface of the coupling groove is needed, and a significantly long period of time may be taken to perform such precise processing, resulting in increased product costs.

Therefore, the compressor according to the present disclosure may further include a pre-machined elastic member disposed between the other end of the vane and the coupling groove, instead of precisely processing the coupling groove of the rolling piston.

The coupling relationship among the rolling piston 300, the elastic member, and the vane 500 will hereinafter be described with reference to the other drawings.

Figure 6:
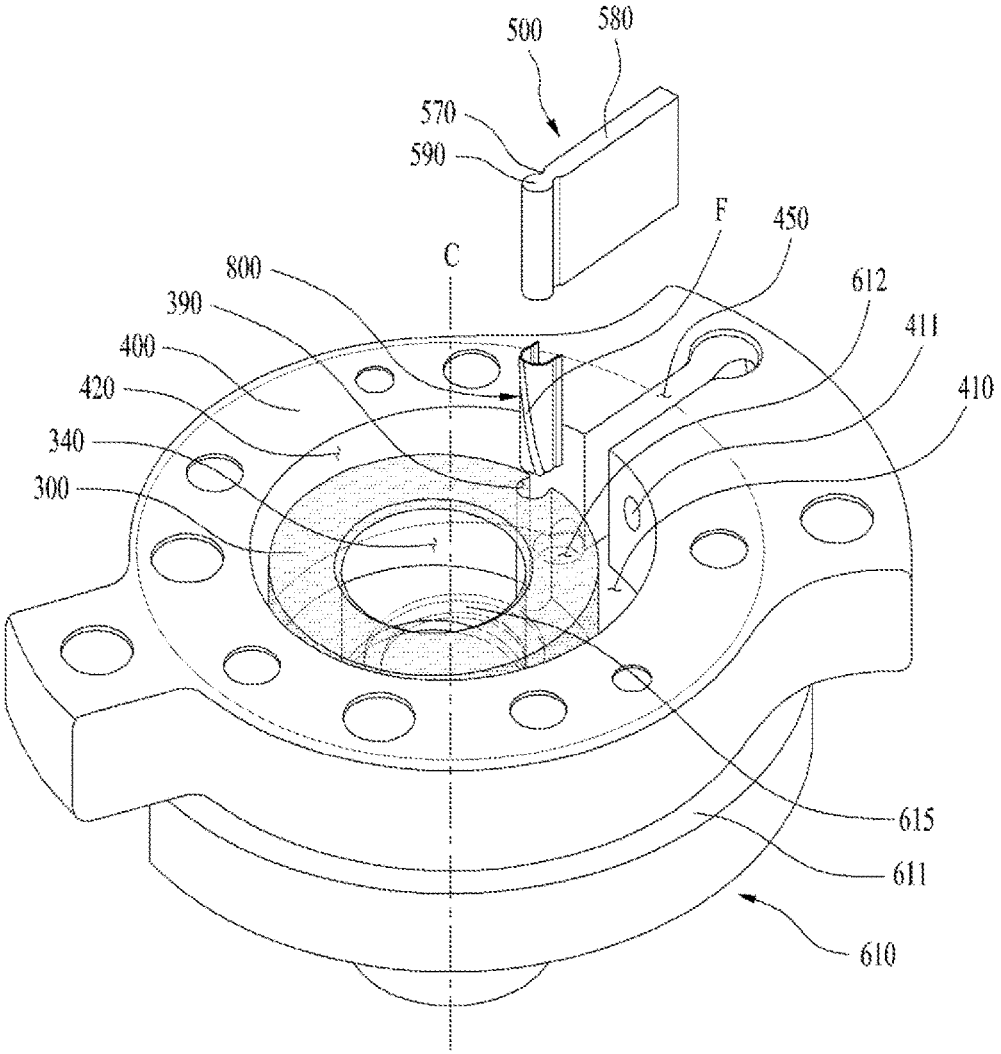
FIG. 6 is a perspective view illustrating the coupling relationship among a rolling piston, an elastic member, and a vane disposed in a cylinder according to another embodiment of the present disclosure.

FIG. 6 is a perspective view illustrating the coupling relationship among the rolling piston, the elastic member, and the vane disposed in a cylinder. In more detail, FIG. 6 is a perspective view illustrating one example of the coupling state between the rolling piston and the vane.

Referring to FIGS. 1 and 6, the eccentric part 240 of the drive shaft 230 may be coupled to the rolling piston 300. For example, the coupling hole 340 may be formed in the radial center part of the rolling piston 300, and the eccentric part 240 may be press-fitted into the coupling hole 340.

The inner space of the cylinder 400 may be divided into the suction chamber 410 and the compression chamber 420. The suction chamber 410 and the compression chamber 420 may be distinguished from each other by the above-mentioned vane 500.

The cylinder 400 may be provided with the inlet 411 through which fluid can be received. The inlet 411 may be formed to communicate with the suction chamber 410. In more detail, the inlet passage 115 may communicate with the suction chamber 410 through the inlet 411.

The first bearing 610 may be provided with the outlet 612 through which the first bearing can communicate with the compression chamber 420. In more detail, the outlet 512 may be formed in the first bearing body 611. The outlet passage 125 and the compression chamber 420 may communicate with each other through the outlet 612.

One end of the vane 500 may be connected to the coupling groove 390 formed in the rolling piston 300. The coupling groove 390 should be formed in a shape corresponding to the circumference of one end of the vane 500, and should prevent the one end of the vane 500 from being separated from the coupling groove 390.

During processing (or machining) of the coupling groove 390, significantly expensive processing costs and a longer processing time may be consumed, resulting in increased product costs.

Therefore, according to the present disclosure, the elastic member 800 may be disposed between one end of the vane 500 and the coupling groove 390. In this case, the coupling groove 390 should be formed in a manner that the elastic member 800 can be elastically inserted therein, so that precise processing of the coupling groove 390 need not be used.

The elastic member 800 may be disposed between the coupling groove 390 and one end of the vane 500. That is, the elastic member 800 may be disposed between the inner circumferential surface of the coupling groove 390 and the outer circumferential surface of one end of the vane 500. For example, the cross-section of the inner circumferential surface of the coupling groove 390 may be formed in an approximately U-shape, and the cross-section of the elastic member 800 may also be formed in an approximately U-shape.

The elastic member 800 may be formed to surround at least some parts of the circumference of one end of the vane 500. Therefore, according to the present disclosure, instead of processing the coupling groove 390 to be formed in a shape corresponding to one end of the vane 500, the inner circumferential surface of the elastic member 800 may be processed in a shape corresponding to one end of the vane 500, so that the resultant elastic member 800 may be disposed in the coupling groove 390.

Specifically, the vane 500 may include the slide part 580 slidably inserted into the slide groove 450 and the coupling part 590 oscillatably coupled to the coupling groove 390. The slide part 580 and the coupling part 590 may be integrated with each other. The elastic member 800 may be elastically disposed in the coupling groove 390, and may be installed to oscillate in the radial direction thereof.

The elastic member 800 may be disposed between the coupling groove 390 and the coupling part 590 to surround at least some parts of the circumference of the coupling part 590. The elastic member 800 may be fixed to the coupling groove 390. In addition, the elastic member 800 may be formed to prevent the coupling part 590 from being separated from the radial inner side of the elastic member 800 to the outer side of the elastic member 800.

The height of the coupling groove 390 may be identical to the height of the coupling part 590. In addition, the height of the elastic member 800 may be identical to each of the height of the coupling groove 390 and the height of the coupling part 590.

The coupling part 590 may be provided at one end of the vane 500, and the outer circumferential surface of the coupling part 590 may be formed to have a predetermined curvature. The inner circumferential surface of the elastic member 800 may be formed in a shape corresponding to the inner circumferential surface of the coupling part 590.

That is, the inner circumferential surface of the elastic member 800 may be formed to have a predetermined curvature corresponding to the outer circumferential surface of the coupling part 590.

For example, the coupling part 590 may include the arc part, a cross-section of which is formed in an arc shape having an angle of 180° or more (preferably, at least 200°), and the inner circumferential surface of the elastic member 800 may be formed in a shape corresponding to the shape of the arc part.

When the elastic member 800 is not present, friction may occur between the outer circumferential surface of the coupling part 590 and the inner circumferential surface of the coupling groove 390. In this case, in order to prevent occurrence of seizure between the outer circumferential surface of the coupling part 590 and the coupling groove 390, the coupling part 590 and the coupling groove 390 may be formed of different materials.

In contrast, according to the present disclosure, the vane 500 and the rolling piston 300 may be formed of the same material. That is, the coupling part 590 of the vane 500 and the rolling piston 300 may be formed of the same material. The elastic member 800 and the vane 500 may be formed of different materials.

Meanwhile, as can be seen from FIG. 1, oil supplied through the oil-supply hole 231 of the drive shaft 230 may be branched from the oil-supply hole 231, and may be introduced into the first bearing 610 and the second bearing 620.

Each of the bearings 610 and 620 may include a ring-shaped stepped portion in which oil introduced through the oil-supply hole 231 is stored. In the illustrated embodiment, oil introduced into the first bearing 610 may be stored in the stepped part 615 formed at the center part of the first bearing 610. The stepped part 615 may be formed at the inner surface of the first bearing 610. In detail, the stepped part 615 may be formed at the inner surface of the first bearing body 611.

Oil stored in the stepped part 615 may lubricate one surface of the rolling piston 300 and the inner surface of the first bearing 610. In addition, oil stored in the stepped part 615 may prevent fluid from leaking to a gap between one surface of the rolling piston 300 and the inner surface of the upper bearing 610.

Although not shown in FIG. 6 for convenience of description, the stepped part for storing oil introduced to the second bearing 620 may also be formed in the second bearing 620. The stepped part of the second bearing 620 may be formed at the inner surface (e.g., the top surface of the first bearing body 621) of the second bearing 620.

Meanwhile, when the rotary compressor 10 is driven, friction may occur between the outer circumferential surface of the coupling part 590 and the inner circumferential surface of the elastic member 800. Accordingly, there is a need for oil to be supplied between the outer circumferential surface of the coupling part 590 and the inner circumferential surface of the elastic member 800.

The oil passage F may be provided between the elastic member 800 and one end of the vane 500, and the longitudinal end of the oil passage F may intermittently communicate with the above stepped part, so that oil stored in the stepped part may be introduced into the oil passage F. Embodiments of the oil passage F will hereinafter be described with reference to other drawings.

Figure 7:
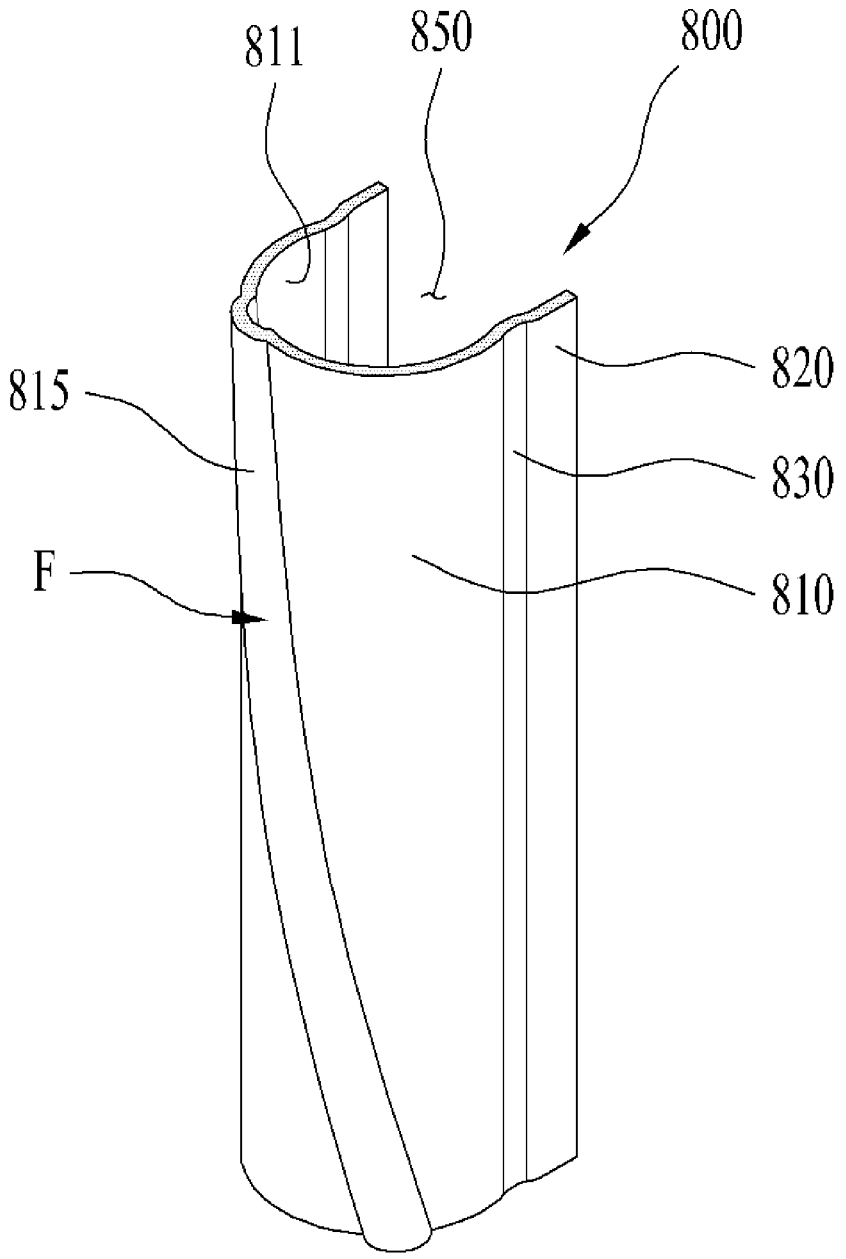
FIG. 7 is a perspective view illustrating the elastic member shown in FIG. 6.
Figure 8:
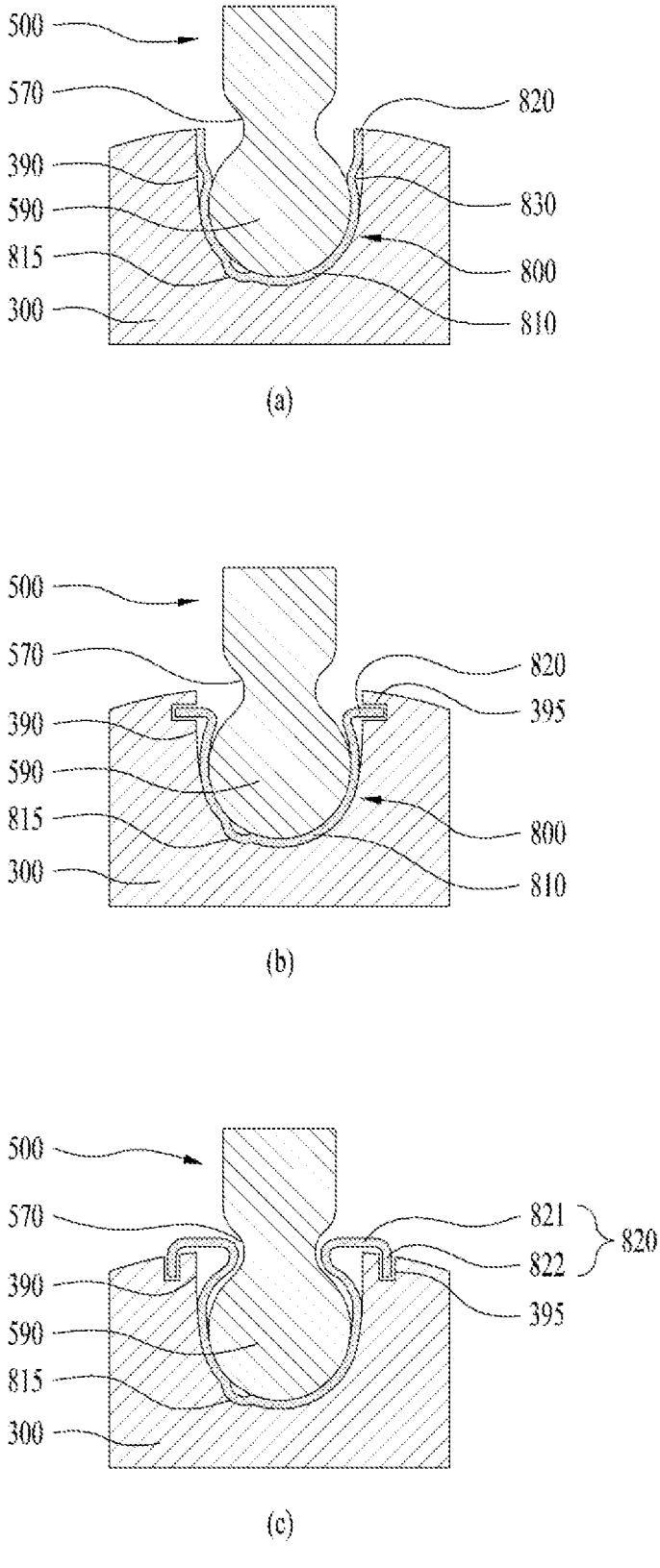
FIG. 8 is a conceptual diagram illustrating various coupling examples between the rolling piston and the elastic member shown in FIG. 6.

Referring to FIGS. 7 and 8, the elastic member 800 may include a body 810 which is curved with a predetermined curvature, an edge part 830 formed to extend from the body 810, and a curved part 830 disposed between the body 810 and the edge part 820.

The body 810, the edge part 820, and the curved part 830 may be formed integrally with each other.

The cross-section of the body 810 may be formed in an approximately U-shape. A reception space for receiving the coupling part 590 of the vane 500 may be provided in the radial inner side of the body 810.

In the illustrated embodiment, the elastic member 800 may be formed in a hollow shaft shape in which an incision part 850 is formed at one side of the circumferential direction thereof. The elastic member 800 may be elastically connected to the coupling groove 390 of the rolling piston 300.

In more detail, the elastic member 800 may include two edge parts 820 spaced apart from each other by a predetermined distance at both ends of the circumferential direction thereof. The incision part 850 may be provided between the edge parts 820 spaced apart from each other.

The inner circumferential surface of the body 810 may be formed in a shape corresponding to the outer circumferential surface of the coupling part 590. That is, the inner circumferential surface of the body 810 may be formed to have a curvature corresponding to the outer circumference of the coupling part 590. Accordingly, the vane 500 may oscillate in the circumferential direction of the coupling part 590 in a state in which the coupling part 590 is in contact with the body 810.

That is, the coupling part 590 may oscillate in the circumferential direction thereof in a state in which the outer circumferential surface of the coupling part 590 is in contact with the inner circumferential surface of the body 810. Here, oscillation of the coupling part 590 may indicate that the coupling part 590 rotates in the circumferential direction in a state in which the coupling part 590 is in contact with the inner circumferential surface 811 of the body 810.

The elastic member 800 may be formed of materials different from those of the rolling piston 300 and the vane 500. Therefore, seizure caused by friction between the elastic member 800 and the rolling piston 300 can be prevented. In addition, seizure caused by friction between the elastic member 300 and the vane 500 (i.e., the coupling part of the vane) can be prevented.

Specifically, during operation of the compressor, a large amount of friction may occur between the inner circumferential surface of the elastic member 800 and the coupling part 590 of the vane 500.

In order to reduce noise caused by such friction as well as to prevent damage of the vane 500 and reduction of compression efficiency, the oil passage F may include an oil passage 815 disposed between the elastic member 800 and the coupling part 590. That is, frictional force between the inner circumferential surface of the elastic member 800 and the coupling part 590 can be reduced by oil supplied through the oil passage 815.

The oil passage 815 may be recessed outward of the radial direction of the elastic member 800 at the inner circumferential surface of the elastic member 800. That is, the oil passage 815 may be formed at the inner circumferential surface 811 of the body 810, and may be recessed outward of the radial direction of the body 810. Both ends of the oil passage 815 may be opened.

One end of the longitudinal direction of the oil passage 815 may intermittently communicate with the stepped part formed in the above-mentioned bearing. Therefore, oil stored in the stepped part of the bearing may be introduced into the oil passage 815.

Specifically, the oil passage 815 may be formed to extend throughout the entire height of the elastic member 800. That is, the oil passage 815 may extend throughout the entire height of the body 810.

Therefore, oil supplied through the oil passage 815 may be used to lubricate the entire height of the elastic member 800 and the coupling part 590.

In addition, the oil passage 815 may extend in a spiral shape in the longitudinal direction of the elastic member 800. In other words, the oil passage 815 may extend in a spiral shape surrounding at least some parts of the circumference of the body 810.

Therefore, the entire circumferential surfaces of the elastic member 800 and the coupling part 590 may be uniformly lubricated by oil supplied through the oil passage 815. That is, when oil is supplied to the oil passage 815, oil may be uniformly applied over the entire height and the entire circumference of the elastic member 800 and the coupling part 590.

On the other hand, as shown in FIG. 6, the vane 500 may further include a concave part 570 disposed between the slide part 580 and the coupling part 590. The slide part 580, the concave part 570, and the coupling part 590 may be formed integrally with each other. The concave part 570 may be recessed in the thickness direction of the vane 500.

The curved part 830 of the elastic member 800 may be formed to protrude toward the concave part 570. That is, the curved part 830 may be formed to protrude inward of the radial direction of the elastic member 800. The curved part 830 and the concave part 570 may be arranged to correspond to each other.

The curved part 830 may prevent the coupling part 590 of the vane 500 from being separated from the elastic member 800.

On the other hand, the above-mentioned elastic member 800 may be fixed into the coupling groove 390 of the rolling piston 300 in a manner that the elastic member 800 is not separated from the coupling groove 390. For example, the elastic member 800 may be coupled to the rolling piston 300 in a manner that the body 710 can elastically move in the coupling groove 390.

In more detail, one pair of edge parts 820 provided at both ends of the circumferential direction of the elastic member 800 may be fixed to the rolling piston 300. That is, the body may elastically move in the coupling groove 390 while being fixed to the rolling piston 300.

Embodiments in which the elastic member 800 is fixed to the inner side of the coupling groove 390 will hereinafter be described with reference to the other drawings.

FIG. 8 is a conceptual diagram illustrating various coupling examples between the rolling piston and the elastic member shown in FIG. 6.

Referring to FIG. 8(*a*), the edge part 820 of the elastic member 800 may be attached to the inner circumferential surface of the coupling groove 390 formed in the rolling piston 300. For example, the edge part 820 may be fixed to the inner circumferential surface of the coupling groove 390 through welding or bonding.

In addition, in a state in which the coupling part 590 of the vane 500 is disposed in the elastic member 800, the inner circumferential surface of the body 810 and the outer circumferential surface of the coupling part 590 may be in contact with each other. In addition, oil may lubricate a gap between the inner circumferential surface of the body 810 and the outer circumferential surface of the coupling part 590 through the oil passage 815.

Since the concave part 830 of the elastic member 800 is formed to protrude toward the concave part of the vane 500, the coupling part 590 can be prevented from being separated outward from the elastic member 800 (i.e., the coupling part 590 can be prevented from being separated toward the outer surface of the coupling groove 390).

Referring to FIG. 8(*b*), the edge part 829 may be inserted into the fixed groove 395 formed in the rolling piston 300. For firm fixation, in a state in which the edge part 820 is inserted into the fixed groove 395, a gap between the edge part 820 and the fixed groove 395 may be bonded or welded.

In the illustrated embodiment, the fixing groove 395 may be recessed from the inner circumferential surface of the coupling groove 390 to the body of the rolling piston 300. That is, the edge part 820 may be formed to extend in a direction along which the edge part moves away from the coupling part 590, and the fixing groove 395 may be recessed in the extension direction of the edge part 820 from the inner circumferential surface of the coupling groove 390.

Referring to FIG. 8(*c*), the fixing groove 395 may be spaced apart from the coupling groove 390 by a predetermined distance. That is, the fixing groove 395 may be formed at the outer circumferential surface of the rolling piston 300. In more detail, the fixing groove 395 may be spaced apart from the coupling groove 390, so that the fixing groove 395 may be recessed from the outer circumferential surface of the rolling piston to the radial inner side of the rolling piston 300.

Some parts of the length of the edge part 820 may be inserted into the fixing groove 395. Specifically, the edge part 820 may include a first extension part 821 and a second extension part 822. The first extension part 821 may extend along the outer circumferential surface of the rolling piston. The second extension part 822 may be curved from the first extension part 821, and may extend in another direction different from that of the first extension part 821. In addition, the second extension part 822 may be inserted into the coupling groove 390.

As described above, since the edge part 820 is inserted into the fixing groove 395, the elastic member 800 can be firmly fixed to the rolling piston 300.

A rotary compressor different in shape from the rotary compressor shown in FIG. 1 will hereinafter be described with reference to the other drawings.

Figure 9:
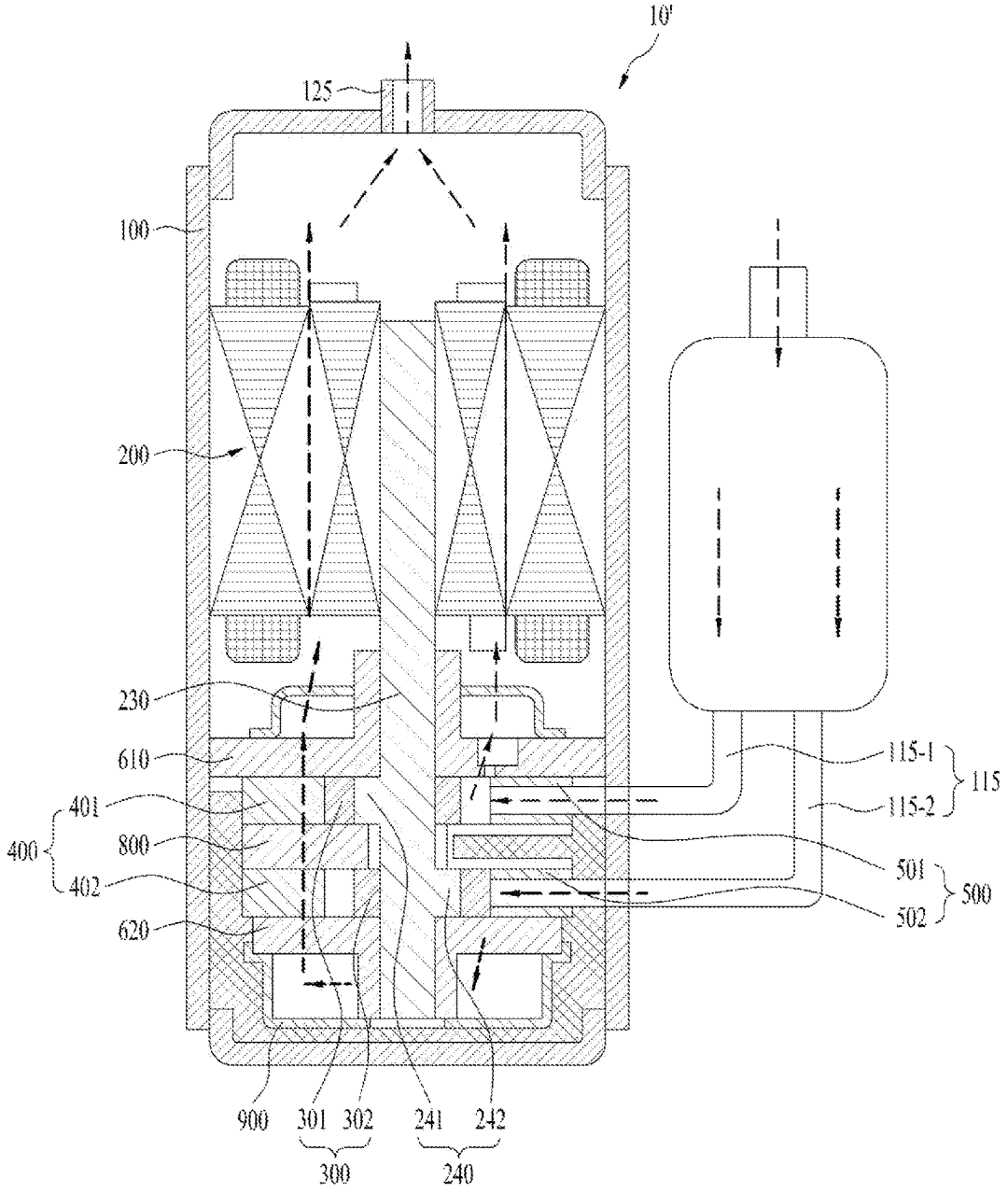
FIG. 9 is a longitudinal cross-sectional view illustrating a rotary compressor according to still another embodiment of the present disclosure.

FIG. 9 is a longitudinal cross-sectional view illustrating a rotary compressor different from the rotary compressor shown in FIG. 1. In more detail, FIG. 6 is a longitudinal cross-sectional view illustrating a twin rotary compressor in which two cylinders and two rolling pistons are installed.

For convenience of description and better understanding of the present disclosure, the following embodiment will hereinafter be described centering upon characteristics different from the rotary compressor shown in FIG. 1, and the same constituent elements as in the first embodiment will herein be omitted for brevity.

Referring to FIG. 9, the rotary compressor 10' according to the present embodiment may also include the motor 200 installed in the case 100, the rolling piston 300 driven by the drive shaft 230 of the motor 200, the cylinder 400 provided with the rolling piston 300, and the vane 500 by which the suction chamber and the compression chamber are distinguished from each other.

The cylinder 400 may include a first cylinder 401 and a second cylinder 402 that are vertically spaced apart from each other. The rolling piston 300 may include a first rolling piston 301 disposed in the first cylinder 401 and a second rolling piston 302 disposed in the second cylinder 402.

The vane 500 may also include a first vane 501 disposed between the first cylinder 401 and the first rolling piston 301 and a second vane 502 disposed between the second cylinder 402 and the second rolling piston 302.

Thus, fluid can be compressed by two compression parts according to the present embodiment. In order to distinguish two compression parts from each other, the spacing between the first cylinder 401 and the second cylinder 402 may be partitioned by an intermediate plate 800.

That is, the upper end of the first cylinder 401 may be covered by the upper bearing 610, and the lower end of the first cylinder 401 may be covered by the intermediate plate 800. In addition, the upper end of the second cylinder 402 may be covered by the intermediate plate 800, and the lower end of the second cylinder 402 may be covered by the lower bearing 620.

In the present embodiment, two inlet passages 115 through which fluid can be introduced into the rotary compressor 10' may be provided. That is, the inlet passage 115 may include a first inlet passage 115-1 communicating with the suction chamber of the first cylinder 401 and a second inlet passage 115-2 communicating with the suction chamber of the second cylinder 402.

The drive shaft 230 may also be provided with two eccentric parts 240. that is, the eccentric parts provided in the drive shaft 230 may be classified into the first eccentric part 241 coupled to the first rolling piston 301 and the second eccentric part 242 coupled to the second rolling piston 302. The first eccentric part 241 and the second eccentric part 242 may be vertically spaced apart from each other in a manner that the first eccentric part 241 and the second eccentric part 242 can respectively correspond to the first rolling piston 301 and the second rolling piston 302.

The rotary compressor 10' according to the present embodiment may further include a muffler 900 for guiding fluid compressed in the second cylinder 402. The muffler 900 may be located below the second cylinder 402. That is, the muffler 900 may be disposed below the lower bearing 620.

Fluid compressed in the first cylinder 402 may be introduced to the discharge passage 125 through the upper bearing 610. Fluid compressed in the second cylinder 402 may be introduced into the muffler 900 through the lower bearing 620, and may then be introduced toward the discharge passage 125 as denoted by arrows of FIG. 9.

In order to avoid repeated description, although a detailed description of the oil passage F is omitted, it should be noted that the oil passage F disposed between the coupling part of the vane and the rolling piston shown in FIGS. 2 to 8 can also be applied to the present embodiment without change.

As is apparent from the above description, the rotary compressor according to the embodiments of the present disclosure can efficiently supply oil to a gap between one end of the vane and the coupling groove of the piston.

The rotary compressor according to the present disclosure can allow an oil film to be formed between one end of the vane and the coupling groove of the piston, thereby preventing leakage of fluid to be compressed.

The rotary compressor according to the present disclosure can reduce product costs and a processing time taken to fabricate the product.

The rotary compressor according to the present disclosure can easily and uniformly supply oil to a frictional surface of the vane.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

Accordingly, the present disclosure is directed to a rotary compressor that substantially obviates one or more problems due to limitations and disadvantages of the related art.

An object of the present disclosure is to provide a rotary compressor for efficiently supplying oil to a gap between one end of a vane and a coupling groove of a piston.

Another object of the present disclosure is to provide a rotary compressor for preventing abrasion of the one end of the vane and the coupling groove of the piston.

Another object of the present disclosure is to provide a rotary compressor for allowing an oil film to be formed between one end of the vane and the coupling groove of the piston, thereby preventing leakage of fluid to be compressed.

Another object of the present disclosure is to provide a rotary compressor for easily coupling the vane to the rolling piston.

Another object of the present disclosure is to provide a rotary compressor for reducing product costs and a processing time taken to fabricate the product.

Another object of the present disclosure is to provide a rotary compressor for easily and uniformly supplying oil to a frictional surface of the vane.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a rotary compressor includes a cylinder, a drive unit, a piston, a vane, and an oil passage. The cylinder includes a suction chamber for suctioning fluid and a compression chamber for compressing fluid. The drive unit rotates a drive shaft by connecting to the cylinder. The piston oscillates in the cylinder by connecting to the drive shaft. The vane extends between the cylinder and the piston so as to separate the suction chamber from the compression chamber, and some parts of the length of the vane are inserted into a slide groove formed in the cylinder. One end of the vane is connected to the coupling groove formed in the piston. The oil passage (F) is disposed between one end of the vane and the rolling piston so as to receive oil therethrough.

The vane includes a slide part slidably inserted into the slide groove, and a coupling part oscillatably coupled to the coupling groove. In this case, the oil passage (F) may be provided between the coupling part and the coupling groove. Therefore, oil can be efficiently supplied between the coupling part and the coupling groove.

The oil passage (F) may be disposed between the outer circumferential surface of the coupling part and the inner circumferential surface of the coupling groove. Therefore, the outer circumferential surface of the coupling part and the inner circumferential surface of the coupling groove may be lubricated by oil.

In accordance with a first embodiment, the oil passage (F) may include a first oil groove provided at an outer circumferential surface of the coupling part. The first oil groove may be recessed inward of the radial direction of the coupling part, and may extend in the height direction of the coupling part.

In accordance with a second embodiment, the oil passage (F) may include a first oil groove provided at an inner circumferential surface of the coupling groove. The second oil groove may be recessed outward of the radial direction of the coupling groove, and may extend in the height direction of the coupling groove.

In accordance with a third embodiment, the oil passage (F) may include a first oil groove formed at the outer circumferential surface of the coupling part, and a second oil groove formed at the inner circumferential surface of the coupling groove. The first oil groove may be recessed inward of the radial direction of the coupling part, and may extend in the height direction of the coupling part. The second oil groove may be recessed outward of the radial direction of the coupling groove, and may extend in the height direction of the coupling groove.

In accordance with a third embodiment, the first oil groove and the second oil groove may be formed to have shapes corresponding to each other. The first oil groove and the second oil groove may be arranged to intermittently face each other during oscillation of the piston.

The oil passage (F) may be formed to extend in a spiral shape in the height direction of the coupling part or the coupling groove. Therefore, oil can be evenly applied over the entire circumference of the coupling part and the coupling groove.

The oil passage (F) may extend throughout the entirety of the height direction of the coupling part or the coupling groove. Therefore, oil can be evenly applied throughout the entire height of the coupling part and the coupling groove.

Upper and lower ends of the oil passage (F) may be opened. Therefore, oil can be supplied to the oil passage (F) through the opened part of the oil passage (F).

The coupling part may include an arc part, a cross-section of which is formed in an arc shape having an angle of 180° or more, and the inner circumferential surface of the coupling groove may be formed to correspond to the shape of the arc part. The oil passage (F) may be arranged to at least one of the arc part of the coupling part and the inner circumferential surface of the coupling groove.

The piston may be coupled to an eccentric part provided in the drive shaft. Therefore, during rotation of the drive shaft, the piston may oscillate in the cylinder.

The rotary compressor may further include a case forming an external appearance of the rotary compressor. Oil stored in a lower part of the case may be supplied to at least one bearing supporting the drive shaft through an oil-supply hole formed in the drive shaft. The ring-shaped stepped part to store oil therein may be provided in the bearing. The longitudinal end of the oil passage F may intermittently communicate with the stepped part.

The bearing may include an upper bearing coupled to the cylinder at an upper side of the cylinder, and a lower bearing coupled to the cylinder at a lower side of the cylinder.

The stepped part may be provided in each of the bottom surface of the upper bearing and the top surface of the lower bearing.

In accordance with another aspect of the present disclosure, a rotary compressor includes a cylinder, a piston, a vane, and an elastic member. The cylinder includes a suction chamber for suctioning fluid and a compression chamber for compressing fluid. The piston oscillates in the cylinder by connecting to the cylinder. The vane extends between the cylinder and the piston so as to separate the suction chamber from the compression chamber, and some parts of the length of the vane are inserted into a slide groove formed in the cylinder. One end of the vane is connected to the coupling groove formed in the piston. The elastic member may be disposed between the coupling groove and one end of the vane, and may surround at least some parts of the circumference of the one end of the vane.

The vane may include a slide part slidably inserted into the slide groove, and a coupling part oscillatably coupled to the coupling groove. The elastic member may be disposed between the coupling groove and the coupling part so as to surround at least some parts of the circumference of the coupling part.

As a result, precise processing of the coupling groove of the piston need not be carried out, so that a time taken to fabricate products can be shortened and product costs can be reduced.

The inner circumferential surface of the elastic member may be formed to have a predetermined curvature corresponding to the outer circumferential surface of the coupling part. Therefore, the coupling part can smoothly rotate along the inner circumference of the elastic member in a state in which the coupling part is disposed in the elastic member.

The vane may be formed of the same material as the piston. The elastic member may be formed of materials different from those of the vane. Therefore, not only seizure between the vane and the elastic member, but also seizure between the piston and the elastic member can be prevented.

The elastic member may extend to have the same height as the coupling part. Therefore, the coupling part may be supported by the inner circumferential surface of the elastic member throughout the height direction of the coupling part.

The oil passage (F) may be provided between the elastic member and the coupling part. The oil passage (F) may be recessed outward of the radial direction of the elastic member at the inner circumferential surface of the elastic member.

The oil passage (F) may extend through the entire height of the elastic member. The oil passage (F) may extend in a spiral shape in the height direction of the elastic member.

Therefore, the entire height and the entire circumference of the elastic member and the coupling part may be evenly lubricated by oil through the oil passage (F).

The elastic member may be formed in a hollow shaft shape in which an incision part is formed at one side of the circumferential direction of the elastic member, and the elastic member may be elastically connected to the coupling groove.

The vane may further include a concave part disposed between the slide part and the coupling part. The concave part may be recessed in a thickness direction of the vane. The elastic member may include a curved part formed to protrude toward the concave part. Therefore, the coupling part of the vane can be prevented from being separated from the inside of the elastic member.

One pair of edge parts provided at both ends of the circumferential direction of the elastic member may be fixed to the piston. In more detail, the one pair of the edge parts may be inserted into the fixing groove formed in the piston. For example, the fixing groove may be formed at the inner circumferential surface of the coupling groove or at the outer circumferential surface of the piston.

Therefore, the elastic member may be disposed in the coupling groove in a state in which the elastic member is firmly fixed to the piston.

In accordance with still another embodiment, the rotary compressor may include first and second cylinders vertically spaced apart from each other by a predetermined distance. The piston may include a first piston disposed in the first cylinder and a second piston disposed in a second cylinder. The vane may include a first vane disposed between the first cylinder and the first piston and a second vane disposed between the second cylinder and the second piston. In this case, the spacing between the first cylinder and the second cylinder may be partitioned by an intermediate plate.

It is to be understood that both the foregoing general description and the following detailed description of the present disclosure are exemplary and explanatory and are intended to provide further explanation of the invention as claimed.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor comprising:

a cylinder that includes a suction chamber for suctioning fluid, a compression chamber for compressing fluid, and a slide groove that extends from inside of the cylinder to outside of the cylinder;

a drive device configured to rotate a drive shaft penetrating through the cylinder;

a bearing coupled to the cylinder to support the drive shaft and shield the inside of the cylinder;

a rolling piston coupled to the drive shaft inside the cylinder and configured to compress the fluid in the cylinder, wherein the rolling piston includes a coupling groove formed on an outer peripheral surface of the rolling piston;

a vane configured to separate the suction chamber from the compression chamber, wherein the vane includes a slide part slidably inserted into the slide groove, and a coupling part that extends from the slide part and oscillatably coupled to the coupling groove;

an oil passage provided in at least one of the coupling groove or the coupling part and configured to supply oil to the coupling groove or the coupling part, and wherein the bearing includes a step part provided on one surface facing the oil passage to intermittently communicate with the oil passage and configured to receive oil and to supply oil to the oil passage, wherein the oil passage includes a first oil groove recessed in an outer peripheral surface of the coupling part and extending from a first end to a second end corresponding to the coupling part, and wherein the second end of the first oil groove is provided to connect to the step part and configured to receive the oil from the step part.

2. The rotary compressor according to claim 1, wherein:

the oil passage is provided between the coupling part of the vane and the coupling groove of the rolling piston.

3. The rotary compressor according to claim 2, wherein:

the oil passage includes a second oil groove provided at an inner surface of the coupling groove, and the second oil groove is recessed in the coupling groove, and the second oil groove extends in a height direction of the coupling groove.

4. The rotary compressor according to claim 3, wherein a shape of the first oil groove corresponds to a shape of the second oil groove.

5. The rotary compressor according to claim 4, wherein the first oil groove and the second oil groove are arranged to intermittently face each other during oscillation of the rolling piston.

6. The rotary compressor according to claim 2, wherein the oil passage extends in a height direction of the coupling part or the coupling groove while spirally winding at least a part of the coupling part or the coupling groove.

7. The rotary compressor according to claim 2, wherein the oil passage extends along an entire height of the coupling part or the coupling groove.

8. The rotary compressor according to claim 2, wherein a first end of the oil passage is opened, and a second end of the oil passage is opened.

9. The rotary compressor according to claim 2, further comprising an elastic member disposed between the coupling groove and the coupling part, and configured to surround part of a surface of the coupling part of the vane.

10. The rotary compressor according to claim 9, wherein an inner surface of the elastic member has a predetermined curvature corresponding to an outer surface of the coupling part.

11. The rotary compressor according to claim 9, wherein:

the vane is formed of a same material as the rolling piston; and the elastic member is formed of different materials than the vane.

12. The rotary compressor according to claim 9, wherein a height of the elastic member is equal to a height of the coupling part.

13. The rotary compressor according to claim 9, wherein the oil passage is provided between the elastic member and the coupling part.

14. The rotary compressor according to claim 13, wherein the oil passage is recessed in the inner surface of the elastic member.

15. The rotary compressor according to claim 14, wherein the oil passage extends along an entire height of the elastic member.

16. The rotary compressor according to claim 15, wherein the oil passage extends in a height direction of the elastic member while having a spiral winding along the elastic member.

17. The rotary compressor according to claim 9, wherein:

the elastic member has a hollow shaft shape in which an incision part is formed at one side of a surface of the elastic member.

18. The rotary compressor according to claim 9, wherein the elastic member includes one pair of edge parts provided at both ends of a surface of the elastic member and the edge parts are attached to the rolling piston.

19. The rotary compressor according to claim 18, wherein the one pair of the edge parts is inserted into a fixing groove at the rolling piston.

* * * * *